US006067697A

United States Patent [19]

Savikurki et al.

[11] Patent Number: 6,067,697

[45] Date of Patent: May 30, 2000

[54] METHOD FOR REMOVING A PROPELLER ASSEMBLY FROM AND FOR MOUNTING THE SAME IN AN OPENING IN THE BOTTOM OF A SWIMMING VESSEL

[75] Inventors: Jarmo Savikurki, Rauma, Finland; Chris Gale, Saffron Walden, United Kingdom

[73] Assignee: Kamewa Finland Oy, Rauma, Finland

[21] Appl. No.: 09/117,135

[22] PCT Filed: Jan. 23, 1997

[86] PCT No.: PCT/FI97/00028

§ 371 Date: Jul. 23, 1998

§ 102(e) Date: Jul. 23, 1998

[87] PCT Pub. No.: WO97/27102

PCT Pub. Date: Jul. 31, 1997

[30] Foreign Application Priority Data

Jan. 24, 1996 [FI] Finland ..... 960319

[51] Int. Cl.[7] ..... B23P 19/00

[52] U.S. Cl. ..... 29/426.1; 440/54; 440/112

[58] Field of Search ..... 29/426.1, 402.08; 440/53, 54, 68, 69, 111, 112

[56] References Cited

U.S. PATENT DOCUMENTS

| | | |
|---|---|---|
| Re. 24,451 | 4/1958 | Daniels . |
| 578,879 | 3/1897 | Johansen . |
| 1,124,645 | 1/1915 | Overton . |
| 2,156,938 | 5/1939 | Edwards . |
| 2,302,795 | 11/1942 | Noble . |
| 2,633,817 | 4/1953 | Pedranti . |
| 2,987,027 | 6/1961 | Wanzer . |
| 3,483,843 | 12/1969 | Hawthorne . |
| 3,734,050 | 5/1973 | Kitai et al. . |
| 3,807,347 | 4/1974 | Baldwin . |
| 3,924,556 | 12/1975 | Wacker . |
| 4,036,163 | 7/1977 | Pehrsson . |
| 4,175,511 | 11/1979 | Krautkremer . |
| 4,573,929 | 3/1986 | Savikurki et al. . |
| 5,397,255 | 3/1995 | Heer . |
| 5,435,762 | 7/1995 | Reuter . |

FOREIGN PATENT DOCUMENTS

| | | | |
|---|---|---|---|
| 11200 | 2/1838 | France | 440/54 |
| 112261 | 8/1900 | Germany | 440/54 |
| 3718-222 | 2/1988 | Germany | 440/54 |
| 14776 | 7/1904 | United Kingdom | 440/54 |

*Primary Examiner*—David P. Bryant
*Attorney, Agent, or Firm*—Marshall & Melhorn

[57] ABSTRACT

The invention relates to a method and apparatus for installing a propeller assembly in an opening in the bottom of a swimming vessel and for removing the propeller assembly from the opening. The propeller assembly comprises an underwater section including the actual propeller and a top section inside the vessel, between which is fitted a flange element for tightly sealing the opening. The apparatus comprises a hoisting chamber, which is fitted in the opening in the bottom of a vessel, extends inside the vessel to above waterline and surrounds the top section of the propeller assembly. The apparatus further includes guide elements for guiding the propeller assembly during the course of lifting or lowering. In the method, the propeller assembly is lifted away by way of the top of the hoisting chamber after clampings of the propeller assembly to the hull of a vessel are unfastened and hoisting means are secured to the propeller assembly. Installation proceeds in a reversed order.

3 Claims, 3 Drawing Sheets

METHOD FOR REMOVING A PROPELLER ASSEMBLY FROM AND FOR MOUNTING THE SAME IN AN OPENING IN THE BOTTOM OF A SWIMMING VESSEL

BACKGROUND OF THE INVENTION

The present invention relates to a method as set forth in the preamble of claim 1 for removing a propeller assembly from and for mounting the same in an opening in the bottom of a swimming vessel as well as to an apparatus as set forth in the preamble of claim 4.

SUMMARY OF THE INVENTION

An object of the present invention is to provide an improved and relatively simple and reliable method and apparatus for removing and mounting a propeller assembly for maintenance, repairs or replacement without having to bring the vessel to dock. This is particularly important in connection with various rig platforms used by off-shore industry, said rigs being often designed to remain stationary for long periods of time, e.g. up to 20 years. In the prior art, the propeller assemblies have been installed and removed from outside the vessel by means of various hoisting mechanisms. In a normal case, these necessitate the use of a diver for securing the hoisting cables to the propeller assembly. A drawback in such externally performed removal and installation of a propeller assembly is that such operations are highly dependent on weather conditions. In poor weather, a diver cannot be used for such operations for reasons of safety.

In order to achieve the above-described object of invention, a method of the invention is characterized by what is set forth in the characterizing clause of claim 1. On the other hand, an apparatus of the invention is characterized by what is set forth in the characterizing clause of claim 4.

BRIEF DESCRIPTION OF THE DRAWING

The invention will now be described with reference made to the accompanying drawings, in which.

DETAILED DESCRIPTION OF THE PREFERRED EMBODIMENTS

Figure 1:
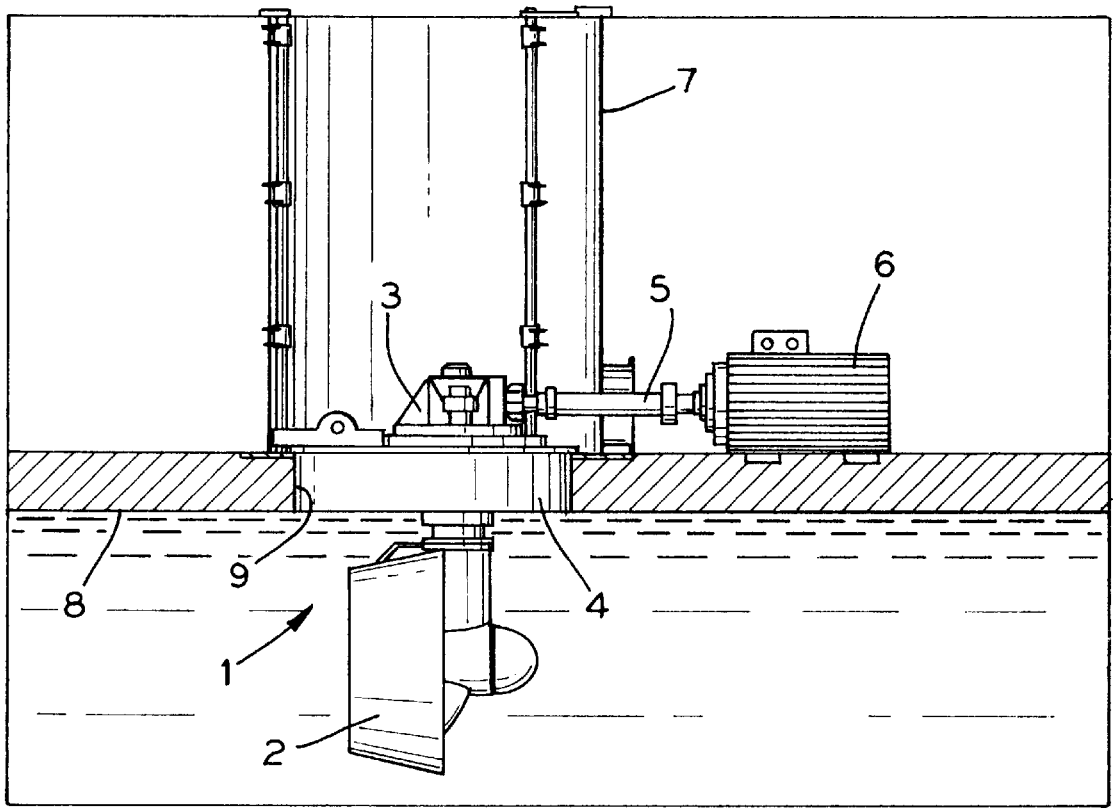
FIGS. 1–3 depict one apparatus of the invention at various stages of removing a propeller assembly.
Figure 2:
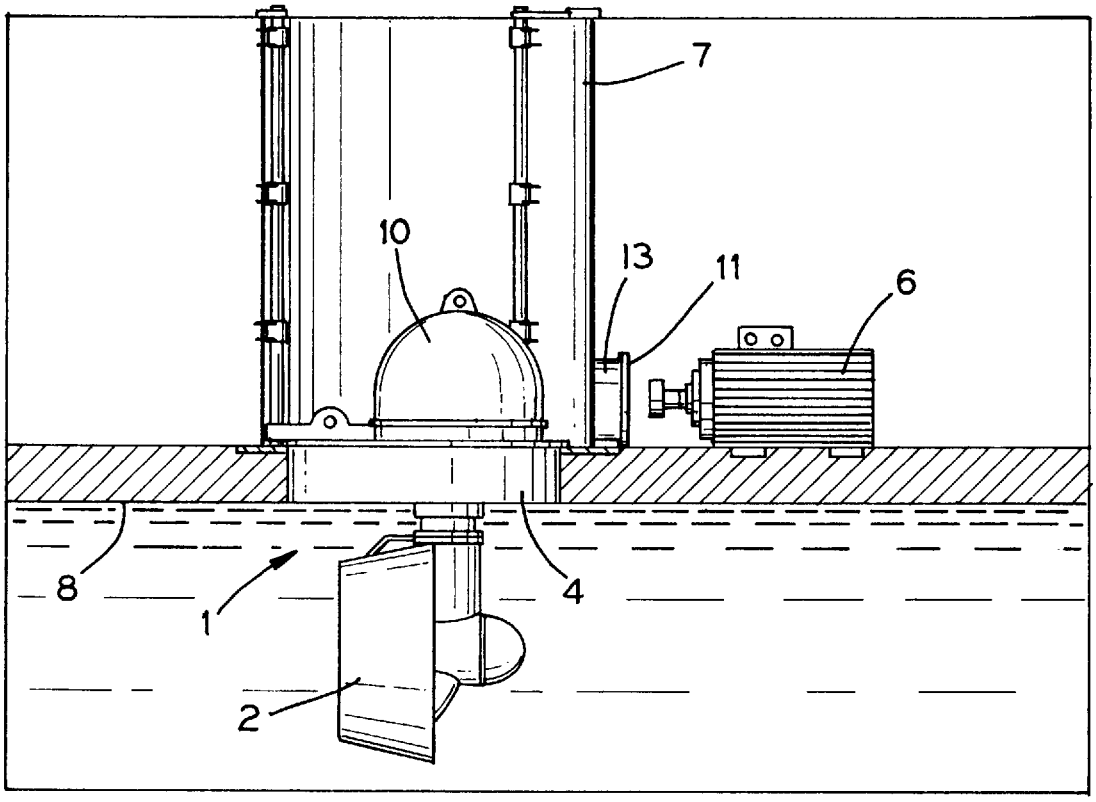
Figure 3:
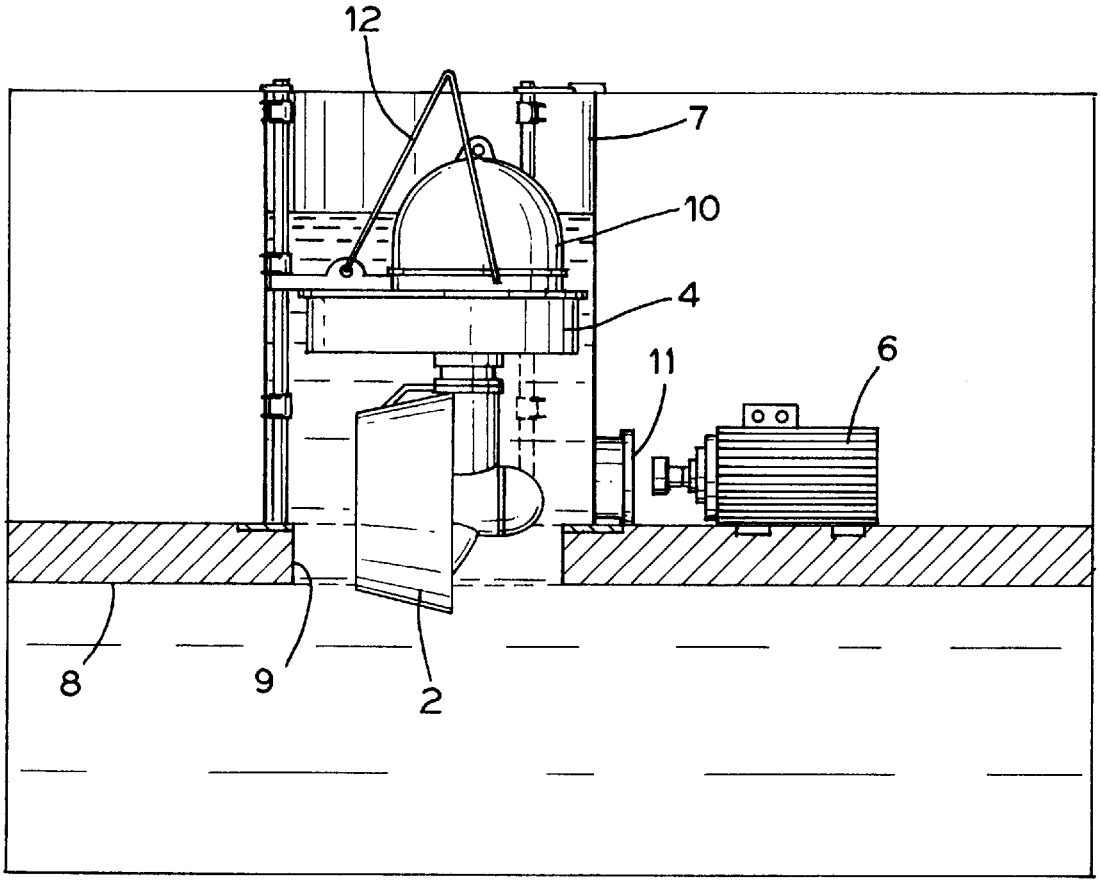

FIGS. 1–3 illustrate an apparatus for removing a propeller assembly 1 from and for mounting the same in an opening 9 in a vessel bottom 8. The illustrated propeller assembly 1 comprises an underwater section 2, including the actual propeller, as well as a top section 3 inside the vessel, between which is a flange element 4 for tight sealing of the opening 9. The propeller is coupled through the intermediary of appropriate gear means to a gear shaft 5, which is in turn connected to power means 6, e.g. an electric motor or a diesel engine. In the depicted embodiment, the gear shaft 5 is removable. The opening 9 is associated with a hoisting chamber 7, extending upwards inside the vessel to above waterline and having its bottom portion provided with a passage 13 for the gear shaft 5. The hoisting chamber 7 is designed to be watertight.

Furthermore, inside the hoisting chamber 7 are included guide elements, not shown, for holding the propeller assembly 1 in a correct position during lifting and lowering.

The following describes the operations for removing and lifting the propeller assembly 1 from the opening 9. The description is but an example of one preferred implementation and is by no means intended to limit the scope of protection defined in the claims for the invention.

Firstly, the gear shaft 5 is disengaged from between the top section 3 of the propeller assembly 1 and the power unit 6, at the same time removing pertinent electrical wires and hydraulic tubes and other possible pipes. Next, the passage 13 is sealed with a watertight flange 11 (FIG. 2) and the top section 3 of the propeller assembly 1 is covered with a watertight protective casing 10. The next step is to unfasten the clamping elements which secure the propeller assembly to the hull of a vessel and to fasten hoisting cables 12 to the propeller assembly 1 and to let the water in the hoisting chamber 7. Finally, the propeller assembly 1 is lifted by way of the top of the hoisting chamber 7 and carried away for necessary procedures. Installation of the propeller assembly 1 into the opening 9 proceeds in a reversed order. The removal of water remaining in the hoisting chamber 7 during the course of installation can be effected by means of conventional pump equipment.

The apparatus can be subjected to a number of modifications without departing from the scope of protection defined in the claims for the invention. For example, the top section 3 of the propeller assembly 1 could be originally designed to be totally resistant to pressure water, whereby the use of a separate protective casing 10 is not necessary.

What is claimed is:

1. A method for removing a propeller assembly, fastened to the hull of a swimming vessel, from an opening in the bottom of said vessel, said propeller assembly comprising an underwater section, including a propeller, and a top section inside said vessel coupled to power means for driving said propeller, said opening provided with a watertight hoisting chamber with an open top extending above the waterline inside said vessel and surrounding said top section of said propeller assembly, said underwater and top sections having therebetween a flange element for tightly sealing said opening, said power means being located outside said hoisting chamber and coupled to said propeller assembly by means of a removable gear shaft, said gear shaft being adapted to extend through a passage in said hoisting chamber, including the steps of:

releasing said propeller assembly from engagement with said power means by removing said gear shaft;

sealing said passage for said gear shaft in a watertight fashion;

unfastening said assembly from the hull of said vessel;

securing hoisting means to said top section of said assembly; and lifting away said assembly through said top of said hoisting chamber.

2. A method as defined in claim 1, wherein water is let into said hoisting chamber prior to commencing, or during, the course of a lift.

3. A method as defined in claim 2, further comprising mounting a protective casing over said top section of said propeller assembly prior to letting water into said hoisting chamber.

* * * * *